US009538828B2

(12) United States Patent
Tarling et al.

(10) Patent No.: US 9,538,828 B2
(45) Date of Patent: Jan. 10, 2017

(54) THERMAL STORAGE COSMETIC APPLICATOR

(71) Applicant: HCT Packaging, Inc., Bridgewater, NJ (US)

(72) Inventors: Christopher John Tarling, New York, NY (US); Armando Villarreal, Santa Moncia, CA (US); Timothy Thorpe, Santa Monica, CA (US)

(73) Assignee: HCT Packaging, Inc., Bridgewater, NJ (US)

( * ) Notice: Subject to any disclaimer, the term of this patent is extended or adjusted under 35 U.S.C. 154(b) by 0 days.

(21) Appl. No.: 13/678,452

(22) Filed: Nov. 15, 2012

(65) Prior Publication Data

US 2013/0121745 A1 May 16, 2013

Related U.S. Application Data

(60) Provisional application No. 61/560,595, filed on Nov. 16, 2011.

(51) Int. Cl.
*A45D 40/26* (2006.01)
*A45D 40/24* (2006.01)

(52) U.S. Cl.
CPC ..... *A45D 40/265* (2013.01); *A45D 40/24* (2013.01); *A45D 2200/155* (2013.01); *A45D 2200/157* (2013.01)

(58) Field of Classification Search
CPC ..... A45D 40/265; A46B 9/021; A46B 2200/1053; A46B 2200/106
USPC ..... 401/1, 118, 119, 123–126, 128, 129; 132/218
See application file for complete search history.

(56) References Cited

U.S. PATENT DOCUMENTS 2,600,426 A 6/1952 Paul
2,755,968 A 7/1956 Fiant
2,982,987 A 5/1961 Knapp
3,602,601 A 8/1971 Zenger et al.
(Continued)

FOREIGN PATENT DOCUMENTS

CN 2606543 Y 3/2004
CN 1499988 A 5/2004
(Continued)

OTHER PUBLICATIONS

U.S. Appl. No. 11/747,078, filed May 10, 2007, Timothy Thorpe, "Dispenser with Thermal Storage Tip," 26 pages.
(Continued)

*Primary Examiner* — Jennifer C Chiang
*Assistant Examiner* — Bradley Oliver
(74) *Attorney, Agent, or Firm* — Seager, Tufte & Wickhem LLP

(57) ABSTRACT

An implement for applying a product to a surface. Some examples of such an implement include a handle, a rod having a top end and a bottom end, the top end of the rod being coupled to the handle, and an applicator having a proximal end attached to the bottom end of the rod. In some examples, the applicator includes (i) a first portion made of metal, ceramic and/or glass and (ii) a second portion made of another material and having a plurality of structures for applying the product to the surface. The first portion is coupled to the second portion. The first portion may include a plurality of channels and the second portion may include a plurality of protrusions.

5 Claims, 9 Drawing Sheets

(56) References Cited

U.S. PATENT DOCUMENTS

| | | | | |
|---|---|---|---|---|
| 3,644,707 | A | 2/1972 | Costello | |
| 3,710,985 | A | 1/1973 | Baum | |
| 3,763,870 | A * | 10/1973 | Montgomery et al. | 132/218 |
| 3,774,231 | A | 11/1973 | Tullos | |
| 3,891,827 | A | 6/1975 | Wyse | |
| 3,908,676 | A | 9/1975 | Levine et al. | |
| 4,029,422 | A | 6/1977 | Pillsbury | |
| 4,056,707 | A | 11/1977 | Farnam | |
| 4,182,497 | A | 1/1980 | Ferreira et al. | |
| 4,465,073 | A | 8/1984 | Schwob | |
| 4,470,715 | A | 9/1984 | Reuchlin et al. | |
| 4,511,427 | A | 4/1985 | Karliner et al. | |
| 4,551,038 | A | 11/1985 | Baker et al. | |
| 4,592,745 | A | 6/1986 | Rex et al. | |
| 4,602,741 | A | 7/1986 | Faulkner, III et al. | |
| 4,662,385 | A * | 5/1987 | Schefer | A46B 9/021 132/218 |
| 4,704,088 | A | 11/1987 | Newman | |
| 4,708,267 | A | 11/1987 | Sieverding et al. | |
| 4,874,117 | A | 10/1989 | Kay et al. | |
| 4,880,326 | A | 11/1989 | Spivey et al. | |
| 5,025,960 | A | 6/1991 | Seager | |
| 5,180,244 | A | 1/1993 | Hirose | |
| 5,316,196 | A | 5/1994 | Reich | |
| 5,531,763 | A | 7/1996 | Mastri et al. | |
| 5,626,472 | A | 5/1997 | Pennetta | |
| 5,816,728 | A | 10/1998 | Nardolillo et al. | |
| 5,951,185 | A | 9/1999 | Kingsford et al. | |
| 6,009,887 | A | 1/2000 | Hertel | |
| 6,027,272 | A | 2/2000 | Spencer et al. | |
| 6,067,997 | A * | 5/2000 | Gueret | A46B 9/021 132/218 |
| 6,102,518 | A | 8/2000 | Taylor | |
| 6,261,014 | B1 | 7/2001 | Altobellis et al. | |
| 6,402,411 | B2 | 6/2002 | Spencer et al. | |
| 6,565,523 | B1 | 5/2003 | Gabourie | |
| 6,669,389 | B2 | 12/2003 | Gueret | |
| 7,082,970 | B2 | 8/2006 | Bartholomew et al. | |
| 7,083,347 | B2 | 8/2006 | Marcotte et al. | |
| 7,306,442 | B2 | 12/2007 | Fox | |
| 7,530,752 | B2 | 5/2009 | Gueret | |
| 7,959,369 | B2 | 6/2011 | Gueret | |
| 2002/0029859 | A1 | 3/2002 | Weaver | |
| 2002/0082625 | A1 | 6/2002 | Huxel et al. | |
| 2002/0121239 | A1 | 9/2002 | Tonazzi et al. | |
| 2002/0164192 | A1* | 11/2002 | Gueret | 401/129 |
| 2002/0166631 | A1 | 11/2002 | Dewitt | |
| 2002/0185396 | A1 | 12/2002 | Mainwaring et al. | |
| 2003/0060925 | A1 | 3/2003 | Bartholomew et al. | |
| 2003/0129363 | A1 | 7/2003 | Hoeft et al. | |
| 2003/0150075 | A1* | 8/2003 | Montoli | A46B 9/021 15/206 |
| 2003/0171762 | A1 | 9/2003 | Forchette et al. | |
| 2004/0127952 | A1 | 7/2004 | O'Phelan et al. | |
| 2004/0190975 | A1 | 9/2004 | Goodman et al. | |
| 2004/0211789 | A1 | 10/2004 | Osborn et al. | |
| 2005/0175786 | A1 | 8/2005 | Singh et al. | |
| 2005/0197268 | A1 | 9/2005 | Buskirk et al. | |
| 2005/0258172 | A1 | 11/2005 | Gueret | |
| 2006/0039742 | A1 | 2/2006 | Cable et al. | |
| 2006/0049203 | A1 | 3/2006 | Boone et al. | |
| 2006/0093425 | A1 | 5/2006 | Gueret | |
| 2006/0216104 | A1 | 9/2006 | Bouix et al. | |
| 2006/0216256 | A1 | 9/2006 | Giniger et al. | |
| 2007/0034224 | A1 | 2/2007 | Dumler | |
| 2007/0186951 | A1 | 8/2007 | Gueret | |
| 2008/0138138 | A1* | 6/2008 | Gueret | 401/118 |
| 2008/0286030 | A1 | 11/2008 | Roder | |
| 2009/0071499 | A1 | 3/2009 | Wyatt et al. | |
| 2010/0037407 | A1 | 2/2010 | Telwar | |
| 2010/0186766 | A1* | 7/2010 | Torii | A45D 40/262 132/218 |
| 2011/0123248 | A1 | 5/2011 | Kim | |
| 2011/0164914 | A1* | 7/2011 | Caulier | A46B 3/18 401/129 |
| 2012/0294664 | A1* | 11/2012 | Gueret | A46B 9/021 401/118 |

FOREIGN PATENT DOCUMENTS

| | | | |
|---|---|---|---|
| CN | 200941885 | Y | 9/2007 |
| EP | 0181184 | A2 | 5/1986 |
| EP | 1563760 | A1 | 8/2005 |
| FR | 1050060 | A | 1/1954 |
| GB | 2448039 | A | 10/2008 |
| JP | 8238884 | A | 9/1996 |
| JP | 2000102583 | A | 4/2000 |
| JP | 2000279870 | A | 10/2000 |
| JP | 2001000497 | A | 1/2001 |
| JP | 2005211182 | A | 8/2005 |
| JP | 2005319300 | A | 11/2005 |
| JP | 2006247037 | A | 9/2006 |
| KR | 20-1998-056332 | U | 10/1998 |
| KR | 20-2005-0000059 | Y1 | 5/2005 |
| KR | 20-2006-0026096 | Y1 | 12/2006 |
| WO | 2010114199 | A1 | 10/2010 |
| WO | WO2011083427 | A2 | 7/2011 |
| WO | WO2013074993 | A1 | 5/2013 |

OTHER PUBLICATIONS

U.S. Appl. No. 13/022,193, filed Feb. 7, 2011, Timothy Thorpe, "Dispenser with Thermal Storage Tip," 25 pages.

U.S. Appl. No. 13/759,966, filed Feb. 5, 2013, David Jeffrey Eberlein, "Cosmetic Device With Active Temperature Modulation," 26 pages.

U.S. Appl. No. 13/840,775, filed Mar. 15, 2013,Timothy Thorpe et al., "Applicator Device or Dispenser With Stone Tip," 41 pages.

U.S. Appl. No. 13/840,889, filed Mar. 15, 2013, Timothy Thorpe et al., "Applicator Device or Dispenser With Applicator Tip Assembly," 41 pages.

Affidavit of Jenny Hsu, State of California, county of Lost Angeles, Jan. 25, 2013, 3 pages.

Affidavit of Jenny Hsu, Attachment A, "2009 HBA IPDA Winners Announced" Beauty Packaging Magazine, Oct./Nov. 2009, retrieved at <<http://www.beautypackaging.com/articles/2009/10/2009-hba-ipda-winners-announced>>, 3 pages.

Affidavit of Jenny Hsu—Attachment B, "Cosmetic/Personal Care Packaging, 2009 Editor's Choice Award Winner: Personal Care," Cosmetic & Personal Care Packaging Magazine I USA, May 2009, retrieved at <<htlp://www.cpcpkg.com/magazine/09 05 perfekt.php>> 3 pages.

Affidavit Jenny Hsu—Attachment C, "Cosmoprof Bologna Draws Growing International Crowd," BeautyPackaging Magazine, Apr./May 2012, retrieved at <<http://beta.nutraceuticalsworld .comlarticles/20 12/05/cosmoprof-bo logna-draws-growinginternational-crow>> 2 pages.

Affidavit of Jenny Hsu—Attachment D, "HCT's patented cooling tip technology wins award for Clinique Lid Smoothies," BeautyPackaging Magazine, Oct. 2012, Press release, HCT Innovation on demand, 3 pages.

Affidavit of Jenny Hsu—Attachment E, "HCT Develops Dispensing Concept: Zamac Tips Add a High Dose of Cool," Beauty Packaging Magazine, Oct./Nov. 2009, retrived at <<http://www.beautypackaging.com/articles/2009/1O/design-center>> 4 pages.

Affidavit of Jenny Hsu—Attachment F, Park, "HCT produces metal tips for latest Dior cosmetics range," Packging News, Sep. 3, 2009, retrieved at <<http://www.packagjngnews.co.ukldesign/hct-produces-metal-tips-for-latest-diorcosmetics-range/>> 2 pages.

Affidavit of Jenny Hsu—Attachment G, "Vichy Neovadiol of Lip & Eye Contour by HCT Packaging," Packaging Europe, Jun. 2011, 2 pages.

Affidavit of Jenny Hsu—Attachment H, "Armani turns to HCT for new eye serum packs," Packaging News, Sep. 26, 2011, 2 pages.

Affidavit of Jenny Hsu—Attachment I, "Giorgio Armani Regenessence 3.R," Packaging Europe, Sep. 2011, 2 pages.

(56) References Cited

OTHER PUBLICATIONS

Affidavit of Armando Villarreal, State of California, county of Los Angeles, Mar. 19, 2013, 4 pages.
"Blistex—Lip Splash, Rolling Tip Applicator, Lip Moisturizer, SPF for Your Lips, Dermat . . . ", retrieved from the internet on May 10, 2007 at <<http://www.blistex.eu/whats_new.htm>>, 1 page.
Translated Chinese Office Action mailed Mar. 29, 2011 for Chinese Patent Application No. 200710188771.8, a counterpart foreign application of U.S. Pat. No. 7,883,287, 11 pages.
"Communication Accompanying Information Disclosure Statement," for U.S. Appl. No. 13/656,993, Timothy Thorpe, "Dispenser With Thermal Storage Tip," May 13, 2013, 2 pages.
"Cosmogen Innovation in Progress", retrieved on Jun. 20, 2008, 1 page.
"Part Number: CP Series, Description: application notes," V-Infinity, a division of CUI, Inc., Jan. 2009, pp. 1-8.
"Series: CP20, Description: 2.0 A Peltier Module," retrieved on Feb. 5, 2013, at <<http://www.cui.com/Product/Resource/PDF/CP20.pdf>>, CUI, Inc. May 7, 2012, pp. 1-5.
"Energizer L91 Ultimate Lithium," Product Datasheet, retrieved on Feb. 5, 2013, at <<http://data.energizer.com/PDFs/I91.pdf>>, Energizer Holdings, Inc., pp. 1-2.
Translated First Korean Invalidation Brief filed in reference to Korean Patent No. 800,040, dated Nov. 2, 2012, 7 pages.
"Frequently Asked Questions About Our Cooling and Heating Technology," retrieved on Feb. 5, 2013, at <<http://www.tellurex.com/technology/peltier-faq.php>>, Tellurex, 2009-2011, pp. 1-14.
Examiner's Search Report mailed Feb. 13, 2008 for application No. GB0722290.04, 5 pages.
HCT Answer Brief to third Korean invalidation Brief (Summary Translation) in response to Invalidation Action filed in reference to Korean Patent No. 800,040, filed Apr. 29, 2013, 7 pages.
Translated Japanese Office Action mailed Jan. 22, 2013 for Japanese patent application No. 2011-211113, a counterpart foreign application of U.S. Pat. No. 7,883,287, 6 pages.
Translated Japanese Office Action mailed May 27, 2011 for Japanese Patent Application No. 2008-123531, a counterpart foreign application of U.S. Pat. No. 7,883,287.
Translated Korean Office Action mailed Jun. 9, 2011 for Korean patent application No. 10/2008/43257, a counterpart foreign application of U.S. Pat. No. 7,883,287, 5 pages.
Translated Korean Office Action mailed Sep. 29, 2011 for Korean patent application No. 10/2008-43257, a counterpart foreign application of U.S. Appl. No. 11/747,078, 6 pages.
Non-Final Office Action for U.S. Appl. No. 11/747,078, mailed Jun. 16, 2010, Timothy Thorpe, "Dispenser with Thermal Storage Tip," 12 pages.
Final Office Action for U.S. Appl. No. 11/747,078, mailed Oct. 28, 2010, Timothy Thorpe, "Dispenser with Thermal Storage Tip," 7 pages.
Non-Final Office Action for U.S. Appl. No. 13/656,993, mailed on Mar. 21, 2013, Timothy Thorpe, "Dispenser With Thermal Storage Tip", 8 pages.
Non-Final Office Action for U.S. Appl. No. 13/022,193, mailed on May 21, 2012, Timothy Thorpe," Dispenser With Thermal Storage Tip," 10 pages.
Response to Non-Final Office Action for U.S. Appl. No. 11/747,078, dated Sep. 16, 2010, Timothy Thorpe, "Dispenser with Thermal Storage Tip," 18 pages.
Response to Final Office Action for U.S. Appl. No. 11/747,078, dated Dec. 8, 2010, Timothy Thorpe, "Dispenser with Thermal Storage Tip," 10 pages.
Response to Non-Final Office Action for U.S. Appl. No. 13/022,193, dated Jul. 30, 2012, Timothy Thorpe, "Dispenser with Thermal Storage Tip," 18 pages.
The PCT Search Report mailed Apr. 3, 2013 for PCT application No. PCT/US12/065626, 11 pages.
Response to Korean Invalidation Petition (and Summary Translation) in response to Invalidation Action filed in reference to Korean Patent No. 800,040, dated Mar. 25, 2013, 60 pages.
Translated Second Korean Invalidation Brief filed in reference to Korean Patent No. 800,040, dated Jan. 23, 2013, 7 pages.
"Super simple PWM TEC controller," retrieved on Feb. 5, 2013, at <<http://redlum.xohp.pagesperso-orange.fr/electronics/simplePWM-TEC.html>>, Welcome to W's Laser-Projects page!, Vers. 1.0, Aug. 2010, pp. 1-3.
Translated Third Korean Invalidation Brief filed in reference to Korean Patent No. 800,040, dated Mar. 28, 2013, 30 pages.
Supplementary European Search Report mailed Feb. 10, 2015 in corresponding European Patent Application No. 12799506.6.

* cited by examiner

THERMAL STORAGE COSMETIC APPLICATOR

This application claims the benefit of U.S. Provisional Patent Application No. 61/560,595, filed Nov. 16, 2011, which is incorporated herein by reference.

BACKGROUND

Devices exist for dispensing cosmetic, medicinal, or other products. Such devices typically include an applicator for applying the products to portions of an individual's face, head, or body. For example, the applicator may be designed to apply mascara to eyelashes for various effects. In that case, the applicator may have short, densely arrayed bristles and may be employed for applying the mascara to the eyelashes to achieve a desired effect (e.g., to thicken the eyelashes). Another applicator may have longer, less densely arrayed bristles for applying mascara to the eyelashes to achieve an alternative desired effect (e.g., to lengthen the eyelashes). Still another applicator may have curly, densely arrayed bristles for applying the mascara to the eyelashes to achieve another alternative desired effect (e.g., to curl the eyelashes).

Existing applicators have limited functionalities for achieving effects only, without providing any type of treatment, therapy, or sensation. Moreover, existing applicators are typically designed to achieve a particular effect.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
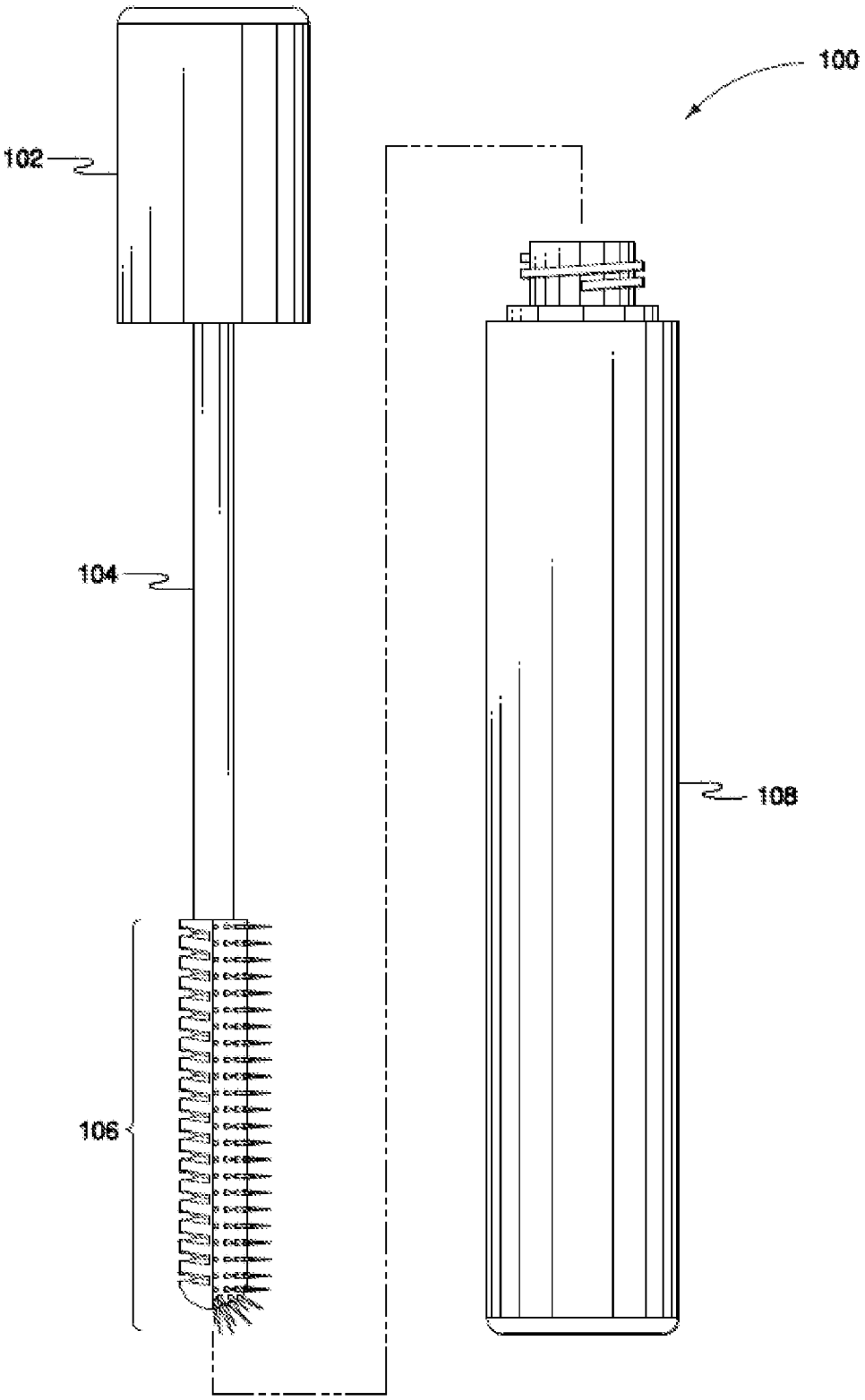
FIG. 1 illustrates a side view of an example implement for applying a product and an example receptacle.

As discussed above, existing applicators have limited functionalities for achieving a cosmetic effect, without providing any type of treatment, therapy, or sensation. Moreover, existing applicators are typically designed to achieve a particular effect. Thus, there remains a need for an improved applicator to accomplish one or more effects, while imparting treatment, therapy, and/or sensation upon application. This disclosure describes cosmetic applicators for applying a cosmetic product (e.g., mascara, lip gloss, lipstick, eye shadow, eyeliner, fragrance, etc.) to a surface such as a face, head, or body of a person, to achieve one or more effects. The cosmetic applicator may also, in some examples, impart a treatment, therapy, and/or sensation (e.g., a cooling or warming treatment, therapy, or sensation) during use.

In one example, a cosmetic applicator system includes an implement having a handle, a rod or wand having a top end coupled to the handle and a bottom end coupled to a proximal end of an applicator. The applicator in this example is constructed, at least partially, from a thermal storage material that is capable of retaining heat or cold for application to a body. The thermal storage material may comprise, for example, a metal, ceramic, glass, and/or other material with a relatively high thermal storage capacity and/or thermal conductivity. When used to apply a cosmetic product to the body, the thermal storage material of the applicator may impart a cooling or warming treatment, therapy, or sensation to the body, thereby accentuating the application of the cosmetic product. The cosmetic applicator system may also include a receptacle configured for receiving the implement and for storing cosmetic product for application by the implement.

In some examples, the applicator may comprise a composite applicator, which includes a first portion made of a first material and a second portion made of a second material. The first material, the second material, or both the first and second materials may comprise a thermal storage material. For instance, the first portion may be made of a thermal storage material, while the second portion is made of a thermally insulating material. Additionally or alternatively, the first portion of the applicator may be designed to achieve a first cosmetic effect, while the second portion of the applicator may be designed to achieve a second cosmetic effect. In one specific example, the first portion of the applicator may include a plurality of channels and the second portion of the applicator may include a plurality of bristles. The plurality of channels of the first portion of the applicator may be constructed from a thermal storage material, such as metal, ceramic, glass, or other material which is capable of retaining and conducting heat or cold for application to a body. The plurality of bristles of the second portion of the applicator may be constructed from a material, other than metal, ceramic, or glass. For example, the bristles may be made of thermoplastic elastomer, low density polyethylene, synthetic polymer, rubber, silicone, or other flexible and/or thermally insulating material.

In another variation of the composite cosmetic applicator described above, the composite applicator may include a first portion made of a thermal storage material and a second portion made of a same or different thermal storage material. For instance, a composite applicator may include a first portion comprising a plurality of channels made of ceramic or glass and a second portion comprising a toothed comb made of metal. Alternatively, both the first portion comprising the plurality of channels and the second portion comprising a toothed comb may be made of metal.

In yet another example, a cosmetics applicator system according to this disclosure may include an implement having multiple applicators. For instance, the implement of this example may include a rod having a first end coupled to a proximal end of a first applicator, a second end coupled to a proximal end of a second applicator, and a middle portion disposed between the first end and the second end. The first applicator, the second applicator, or both the first and second applicators of this example may comprise any of the example applicators described above (e.g., applicators made of thermal storage material, composite applicators, or the like).

By virtue of the thermal retention properties of the applicators (or portions thereof), thermal energy may be applied to the product so that it may be heated or cooled prior to or during application. Moreover, the applicators may transfer heat to or from the user's face, head, or body, causing the user to feel a thermal sensation (e.g., warm or cool depending on the thermal energy in the applicators) when applying the product. In some instances, the heat transfer may also minimize or alleviate pain or discomfort caused by damage to the face, the head, or the body. Furthermore, in the case where the applicator is heated, thermal energy from the applicators may provide thermal energy to the product for easier flow upon application to avoid clumping or reduce a viscosity of the product. In some instances, heating of the applicator may also produce or enhance a desired cosmetic or therapeutic effect of the product being applied (e.g., to promote curling the eyelashes in the case of a mascara applicator, or to promote penetration of the product into the skin or lips in the case of a lotion or lip gloss).

In some examples, the applicators (or portions thereof) need not be heated or cooled prior to or during use. In such examples, simply applying product at ambient temperature may still impart a cooling sensation to the body of the user. The applicator may be sized and shaped such that it is able to quickly dissipate body heat between applications to consistently impart a cooling effect over multiple applications. For instance the mass and volume may be large enough to hold enough thermal energy to impart a sensation to a user, but small enough to allow the applicator to quickly transfer the thermal energy (i.e., to/from the body of the user) and dissipate heat received from the body during application (i.e., by returning to room temperature). Additionally, the applicator may have a shape designed to further increase a speed with which the applicator is able to transfer its thermal energy. For instance, the applicator may be shaped to have relatively large surface area to maximize a heat transfer ability of the applicator. By way of example and not limitation, shapes of the applicator that may be used to provide a relatively large surface area include a thin disk, fins, channels, grooves, etc.

In some examples, thermal storage applicators according to this application may have a volume of at least about 50 millimeters$^3$ and at most about 1000 millimeters$^3$, a mass of at least about 0.1 milligrams and at most about 4 grams, a surface area of at least about 50 millimeters$^2$ and at most about 1000 millimeters$^2$, and/or a surface finish of at least about 0.012 μmeters to at most about 50 μmeters. The terms "volume," "mass," and "surface area," when used in reference to a thermal storage applicator mean the volume, mass, and surface area of thermal storage material included in the applicator. While several embodiments are described below as having certain ranges of volume, mass, surface area, and/or surface finish, the ranges given for each embodiment are merely examples. Any of the embodiments described herein may have or be modified to have a thermal storage applicator (or a portion of an applicator made of thermal storage material) having a volume, mass, surface area, and/or surface finish as specified in this paragraph. In still other examples, thermal storage applicators may have volume, mass, surface area, and/or surface finish above or below the ranges specified in this paragraph.

Also, in some embodiments, thermal storage applicators (or a portion of an applicator made of thermal storage material) may be formed as a solid body made of thermal storage material (e.g., by casting, machining, forging, or the like) or may be formed as a relatively thin shell of thermal storage material disposed about a form made of non-thermal storage or thermally insulating material (e.g., by stamping, dipping, electroplating, vacuum metal deposition, sintering, powder coating, or the like). In either case (solid body or thin shell), the thermal storage material may additionally be coated with another material to modify a surface finish, appearance, or other tactile or visual characteristic of the thermal storage applicator. For instance, a solid body or thin shell thermal storage applicator may be electroplated (e.g., with gold, silver, palladium, Zamac, etc.) to provide a smoother and/or more supple finish. In another example, a solid body or thin shell thermal storage applicator may by coated with a metallic and/or magnetic material (e.g., by powder coating or vacuum metal deposition) to impart a desired aesthetic and/or therapeutic quality to the applicator. The embodiments described herein may be made using the processes described in this paragraph, or other manufacturing processes.

Following this "overview," the disclosure continues with a section entitled "Example Implements with Applicators," which describes non-limiting examples of implements with applicators. Another section entitled "Example Mechanisms of Coupling Applicators" follows, and describes non-limiting examples of coupling mechanisms of the applicators. In yet another section, entitled "Example Uses and Benefits of Applicators" follows, and describes non-limiting applications and beneficial effects. Finally, the discussion ends with a brief conclusion.

This brief overview, including section titles and corresponding description, is provided for the reader's convenience and is not intended to limit the scope of the claims. The features of the described applicator systems and applicators may be implemented in any number of forms. The example applicator systems and applicators described herein are merely illustrative. The embodiments described herein are not mutually exclusive and aspects of the various embodiments may be combined to arrive at other embodiments within the scope of the claims. The features, functions, and advantages that have been discussed above or will be discussed below are merely examples that may, but need not necessarily, be achieved by applicators or applicator systems according to one or more embodiments described herein. Further details of various example embodiments are set forth below with reference to the following description and drawings.

Example Implements with Applicators

FIG. 1 illustrates a side view of an example applicator system 100 including an implement for applying a product and an example receptacle for containing the product and receiving the implement. The illustrated configuration of an applicator system 100 is only one example structure and/or arrangement. Many structures and/or arrangements of the illustrated components, or other similar components, are possible.

The implement in this example includes a handle 102, a wand or rod 104, and an applicator 106. The handle 102 in this example also serves as a cap configured to thread onto and seal the receptacle 108 when the implement is placed in the receptacle. The rod 104 includes a top end and a bottom end, the top end of the rod 104 is coupled to the handle 102. In this example, the handle 102 and the rod 104 may be constructed of plastic (e.g., polypropylene (PP), acrylonitrile butadiene styrene (ABS), Polyoxymethylene (POM)), or any other suitable material. While the rod 104 illustrates a straight configuration, in other embodiments, the rod 104 may be curved, may be bendable, may have an elbow, etc.

The applicator 106 includes a proximal end attached to the bottom end of the rod 104. The applicator 106 in this example is a composite applicator which includes a first portion having a plurality of channels and a second portion disposed on a aside opposite the first portion, the second portion having a plurality of bristles. Details of the channels and the bristles are discussed with reference to FIGS. 2A-2C and 3A-3B.

The applicator system 100 also includes a receptacle 108 for receiving the implement and for storing the mascara. The receptacle 108 may be constructed of plastic (e.g., polypropylene (PP), acrylonitrile butadiene styrene (ABS), polyoxymethylene (POM)), or any other suitable material, for containing the products described below. The receptacle 108 may contain cosmetic products, medicinal products, personal care products, or other types of products. The cosmetic products may include, but are not limited to, mascara, lash growth, lash treatment, conditioner, primer, colorant, brow treatment, nail treatment, lip gloss, lipstick, eye shadow, and the like. The cosmetic products may be in the form of, for example, liquids, gels, creams, oil-based products, wax-based products, water-based products, or the like. While the application describes embodiments usable to apply cosmetic products, the applicator systems and applicators described herein may also be used in connection with other products. The handle 102 constituting the cap includes threads underneath the cap to connect with the threads on the receptacle 108 for storage.

The receptacle 108 in this example has a substantially rectangular cross-sectional shape. However, a variety of receptacle cross-sectional shapes and types are contemplated. For example, the receptacle 108 may have a substantial triangular cross-sectional shape, substantially circular cross-sectional shape (e.g., a cylindrical tube) or any other suitable receptacle shape.

In some embodiments, the receptacle 108 may include a wiper (not shown) which may be housed inside. When included, the wiper is configured to remove any excess product (e.g., mascara) from the applicator 106 when the implement is removed to apply the product to the face (e.g., eyelashes). For this embodiment, the applicator 106 is described in the context of an applicator for applying mascara to eyelashes. However, it should be understood that applicators as described herein may be used and adapted to apply other products and may be used to apply product to other portions of the face, the head, or the body.

Figure 2A:
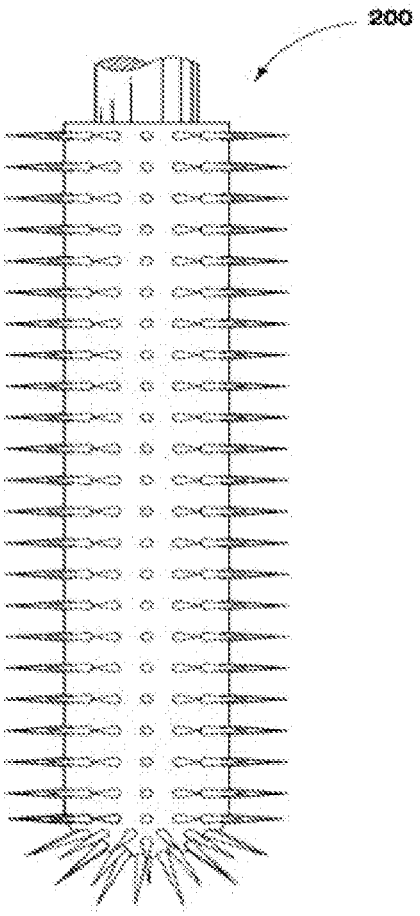
FIG. 2A, FIG. 2B, and FIG. 2C illustrate a front view, a rear view, and an end view, respectively, of an example applicator of the implement of FIG. 1.

FIG. 2A illustrates the front view of the applicator 106, which includes the plurality of bristles 200 shown in greater detail. The plurality of bristles 200 may be constructed of materials including, but not limited to, thermoplastic elastomer (TPE), low density polyethylene (LDPE), synthetic polymer, partially of a resin such as, for example, acrylonitrile butadiene styrene (ABS), styrene acrylonitrile (SAN), pentachlorothioanisole (PCTA), polypropylene (PP), polyethylene (PE), polyurethane, rubber, silicone, combinations thereof, or any other flexible and/or insulating material. In other embodiments, the plurality of bristles 200 may be constructed in whole or in part of materials including, but not limited to, ceramic, glass, metal (e.g., carbon steel, stainless steel, aluminum, chrome, copper, nickel, or titanium), or composite material.

The plurality of bristles 200 extends radially outwards from the second portion of the applicator 106. The plurality of bristles 200 extends along the front and sides of the second portion and along a portion of a distal end of the applicator 106.

Figure 2B:
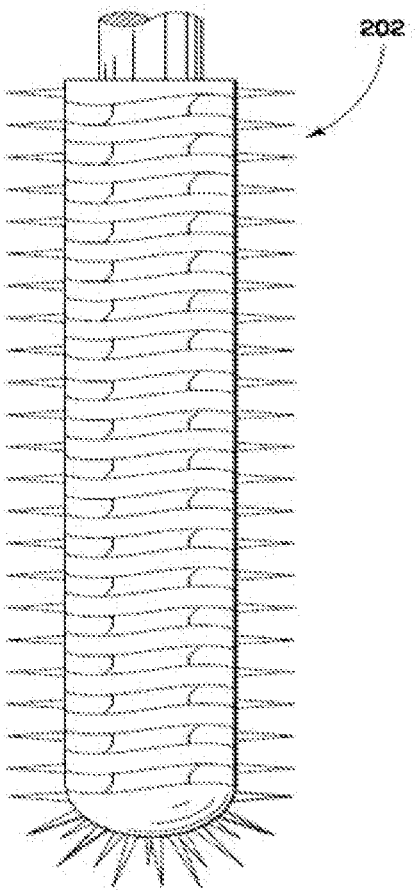

FIG. 2B illustrates a rear view of the applicator 106, which includes the plurality of channels 202 shown in greater detail. The plurality of channels 202 may be constructed of a material capable of holding and retaining a thermal charge. In other embodiments, the plurality of channels 202 may be constructed of any suitable material capable of retaining and/or transferring heat or cold during application of the product. For example, the material may include, but is not limited to, metal, glass, and/or ceramics. The metal may include, carbon steel, stainless steel, aluminum, brass, chrome, copper, gold, nickel, platinum, silver, titanium, alloys, combinations thereof, or the like. In still other examples, the channels may be made of materials other than metal, ceramic, or glass, such as plastics, rubber, polymers, or the like. In any of the foregoing variations, the channels or other thermal storage portion of the applicator (regardless of the underlying material) may be coated with a metal, such as a base metal of zinc and alloying elements of aluminum, magnesium, and copper (e.g., Zamac).

In other embodiments, stones, additives, resin, magnetic components, or any other components may be added separately or in combination to the metal, ceramic, and/or glass. For instance, stones may include but are not limited to, jade, opal, turquoise, amethyst, aquamarine, Tiger's eye, coral, amber, quartz, onyx, and tanzanite. In other embodiments, magnetic components may be added that include but are not limited to, magnetic powders, magnetic compounds, or magnetic strips. The magnetic powders may include but are not limited to, ferrite magnetic powder, barium ferrite magnetic powder, strontium ferrite magnetic powder, rare earth magnetic powder, iron oxide compound, a combination of aluminium (aluminum), nickel, and cobalt (Alnico) with iron and small amounts of other components.

In the illustrated example, the plurality of channels 202 has a generally s-shape or wave pattern. The channels of the plurality of channels 202 extend parallel to each other and substantially perpendicular to a longitudinal axis of the rod 104. In some examples, a channel in the plurality of channels 202 may range from at least about 0.1 millimeters to at most about 10 millimeters in width. The channel may range from at least about 0.1 millimeters to at most about 10 millimeters in height. However in other examples channels may take other shapes and may have widths and/or heights greater than or less than those described herein.

In some example embodiments, the plurality of channels 202 may be constructed of metal that includes a mass of at least about 0.1 milligrams and at most about 2 grams. In some example embodiments, the plurality of channels 202 may have a volume of at least about 0.1 millimeters$^3$ and at most about 900 millimeters$^3$ for a solid volume and may range from a volume of at least about 0.1 millimeters$^3$ and at most about 150 millimeters$^3$ for a shell volume. Also, the plurality of channels 202 in some example embodiments may include a surface finish of less than or equal to about 1 μmeter, in some embodiments the surface finish may be at least about 0.012 μmeters to at most about 0.8 μmeters. The surface finish corresponds to measurements of small scale variations in the height of the physical surface. While dimensions and ranges of mass, volume, and surface finish are provided above for some example embodiments, other embodiments may have dimensions, masses, volumes, and/or surface finishes greater or smaller than the example embodiments described herein.

While element 202 is described as having channels, the element may also be thought of as having fins. The channels or the fins provide a large surface area that allows high rates of heat transfer to/from the body and the surrounding air. As such, the channels/fins serve as a heat sink to quickly transfer heat from the body to the applicator, and then from the applicator to the surrounding air.

Figure 2C:
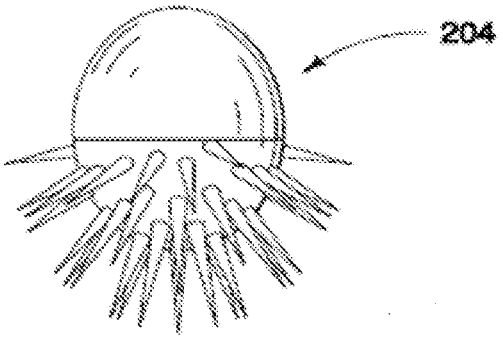

FIG. 2C illustrates an end view of the example applicator 106, which includes the distal end 204 shown in greater detail. FIG. 2C illustrates a geometric cross-sectional shape of the applicator 106 being substantially circular with a semi-circle of the plurality of bristles 200 and the other semi-circle of the plurality of channels 202. In other embodiments, the cross-sectional shape may reflect the geometric shapes of the plurality of bristles 200 and the plurality of channels 202, such as being bulb-shaped, triangular-shaped, square-shaped, or any other suitable applicator shape.

Figure 3A:
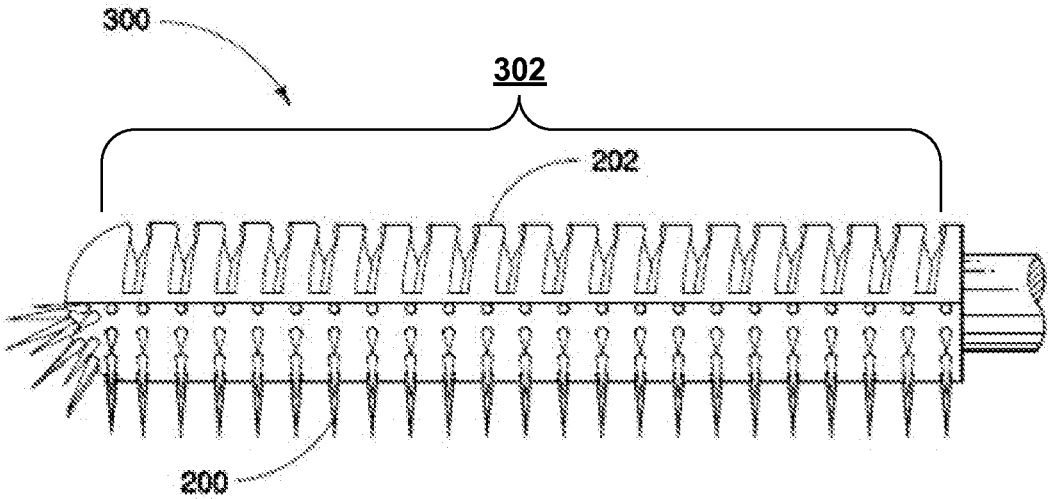
FIG. 3A and FIG. 3B illustrate a side elevation view and a top perspective view, respectively, of the example applicator of the implement of FIG. 1.

FIG. 3A illustrates a side elevation view 300 of the applicator 106. As shown, the plurality of channels 202 couples to the plurality of bristles 200. The plurality of channels 202 may be approximately a same length 302 as the plurality of bristles 200. In another embodiment, the plurality of bristles 200 may be shorter in length than the plurality of channels 202 or vice versa.

The number of channels in the plurality of channels 202 may range from at least about 1 channel to at most about 100 channels. As an example, the number of channels 202 shown is approximately 17 channels. Each channel may be spaced at intervals of about 0.1 to about 1 millimeter apart from each other. However, in other examples the number of channels and/or the spacing between channels may be greater than or smaller than the ranges listed.

Figure 3B:
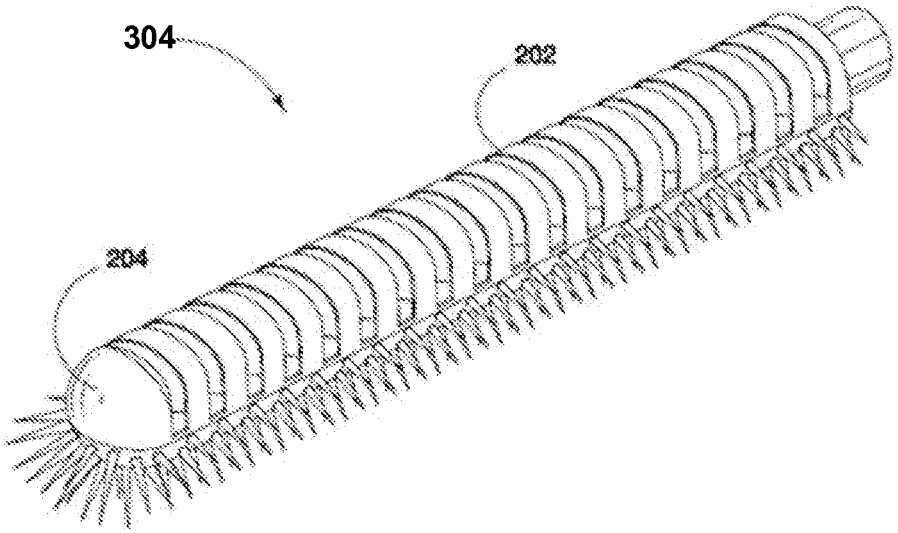

FIG. 3B illustrates a top perspective view 304 of the applicator 106. The top perspective view 304 illustrates the plurality of channels 202 having the substantially semi-circular cross-section. This design facilitates application of the product to the user's face, body, or head. In particular, the plurality of channels may glide through hair on the user's face, body, or head. A curvature radius of the semi-circles may range from about 0.1 to about 2 millimeters. In other embodiments, the plurality of channels 202 may take on other cross-sectional shapes, such as being bulb-shaped, triangular-shaped, square-shaped, or any other suitable applicator shape, or the like. The distal end 204 reflects at least shapes similar to the shapes of the plurality of channels 202.

While features of various illustrative embodiments are described, the applicator 106 with the plurality of bristles 200 and the plurality of channels 202 may be configured in any form suitable for the application of the product contained in the receptacle 108. For example, the plurality of channels 202 may be constructed in any other suitable shape and size and may have any suitable dimensions, volume, mass, surface finish, and/or surface treatment desired for a given application.

Figure 4:
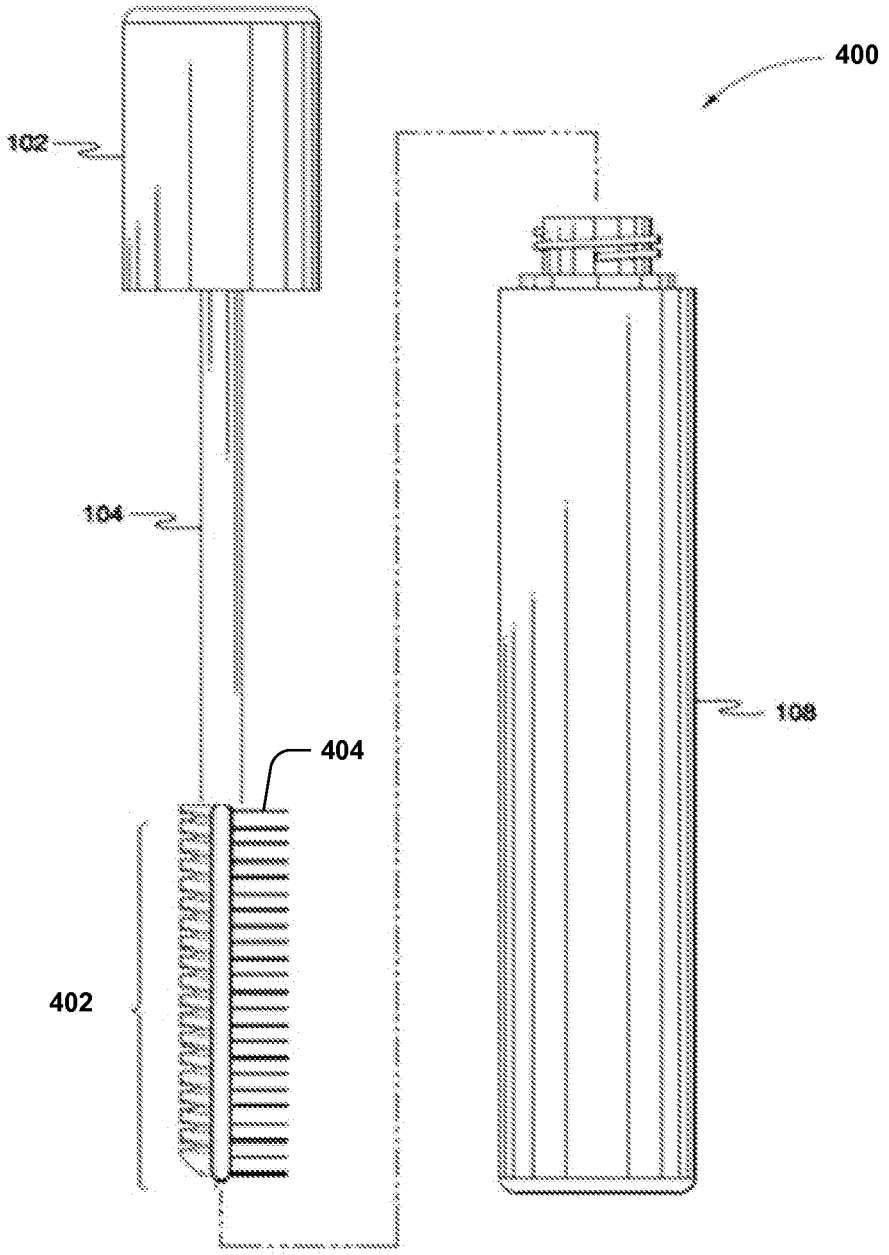
FIG. 4 illustrates a side view of another example implement for applying a product and an example receptacle.
Figure 5:
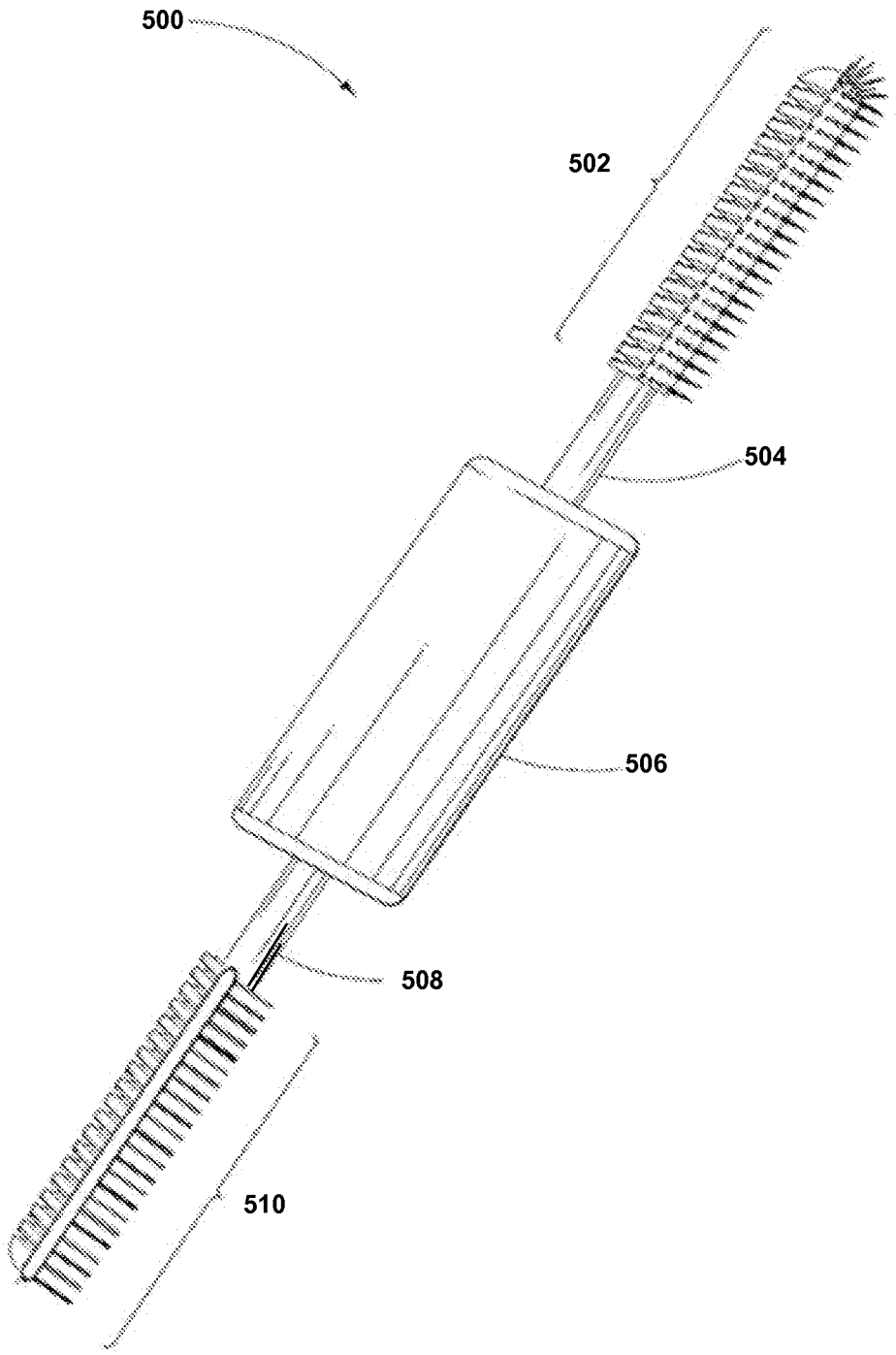
FIG. 5 illustrates a side view of another example implement.

FIGS. 4 and 5 illustrate additional example implements. The illustrative implements in these figures may have features and may be made of materials similar to the components and to the features of the implement as discussed for FIGS. 1-3. However, the following descriptions will focus on features, materials, and uses that are different for other embodiments of the implements.

FIG. 4 illustrates a side view of another example implement for applying a product and a front view of an example receptacle 108. The example applicator system 400 illustrates an implement, which includes the handle 102, the rod 104, and an applicator 402. The rod 104 includes the top end and the bottom end, the top end of the rod 104 is coupled to the handle 102. The applicator 402 includes the proximal end attached to the bottom end of the rod 104. The applicator 402 includes a first portion having a plurality of channels 202 and a second portion having a plurality of teeth 404 formed in a comb configuration. As in the previous examples, the channels may be made of metal, ceramic, and/or glass. The second portion and/or the plurality of teeth 404 may also be constructed of a material capable of holding and retaining a thermal charge. For example, the material may include, but is not limited to, a family of alloys with a base metal of zinc and alloying elements of aluminum, magnesium, and copper (e.g., Zamac), carbon steel, stainless steel, aluminum, brass, chrome, copper, gold, nickel, platinum, silver, titanium, alloys, combinations thereof, or the like.

In other embodiments, only one of the first portion or the second portion may be constructed of a material (e.g., metal, ceramic, and/or glass) capable of retaining and/or transferring heat or cold during application of the product. In that case, the other of the first portion or the second portion may be constructed of material other than metal, ceramic, or glass, such as but not limited to, plastic, polypropylene (PP), low density polyethylene (LDPE), thermoplastic elastomer (TPE), synthetic polymer, rubber, silicone, or the like. As discussed above, other components may be added to the metal, ceramic, and/or glass, such as stones, additives, magnetic components.

The plurality of teeth 404 illustrates one possible configuration. Many arrangements of the illustrated teeth are possible. For example, the number of teeth may vary in the arrangement, the teeth may be spaced closer or farther apart, and the width of the teeth may vary.

In another embodiment, the applicator 402 includes a first portion having a plurality of channels 202 and a second portion having a plurality of protrusions. The plurality of protrusions may include a plurality of clustered bristles (not shown). The plurality of clustered bristles may be arranged in configuration of a brush. The plurality of clustered bristles are configured to stand upright together, similar to a toothbrush. The plurality of clustered bristles may be constructed of materials similar to the materials for the plurality of teeth 404 and for the second portion.

FIG. 5 illustrates a side view of another example implement 500. The implement 500 includes a first applicator 502, a first rod 504, a handle 506, a second rod 508, and a second applicator 510. The implement 500 illustrates two applicators 502, 510 attached at opposite ends.

The first applicator 502 includes the plurality of bristles 200 and the plurality of channels 202. The second applicator 510 includes a plurality of teeth in a comb configuration 404 and the plurality of channels 202. In an embodiment, the first applicator 502 may be used to apply treatment or conditioner products and the second applicator 510 may be used to apply the mascara. In yet another embodiment, the first applicator 502 may be used to apply colorant to eyebrow or hair on the user's face or head and the second applicator 510 may be used to apply the mascara. The order of the applicators may be reversed, such as the second applicator 510 may be used to apply treatment or conditioner products while the first applicator 502 may be used to apply the mascara. Also, the second applicator 510 may be used apply colorant to hair on the user's face or head the first applicator 502 may be used to apply the mascara. In still other embodiments, the first and second applicators may be used to apply other products to other surfaces.

Figure 6:
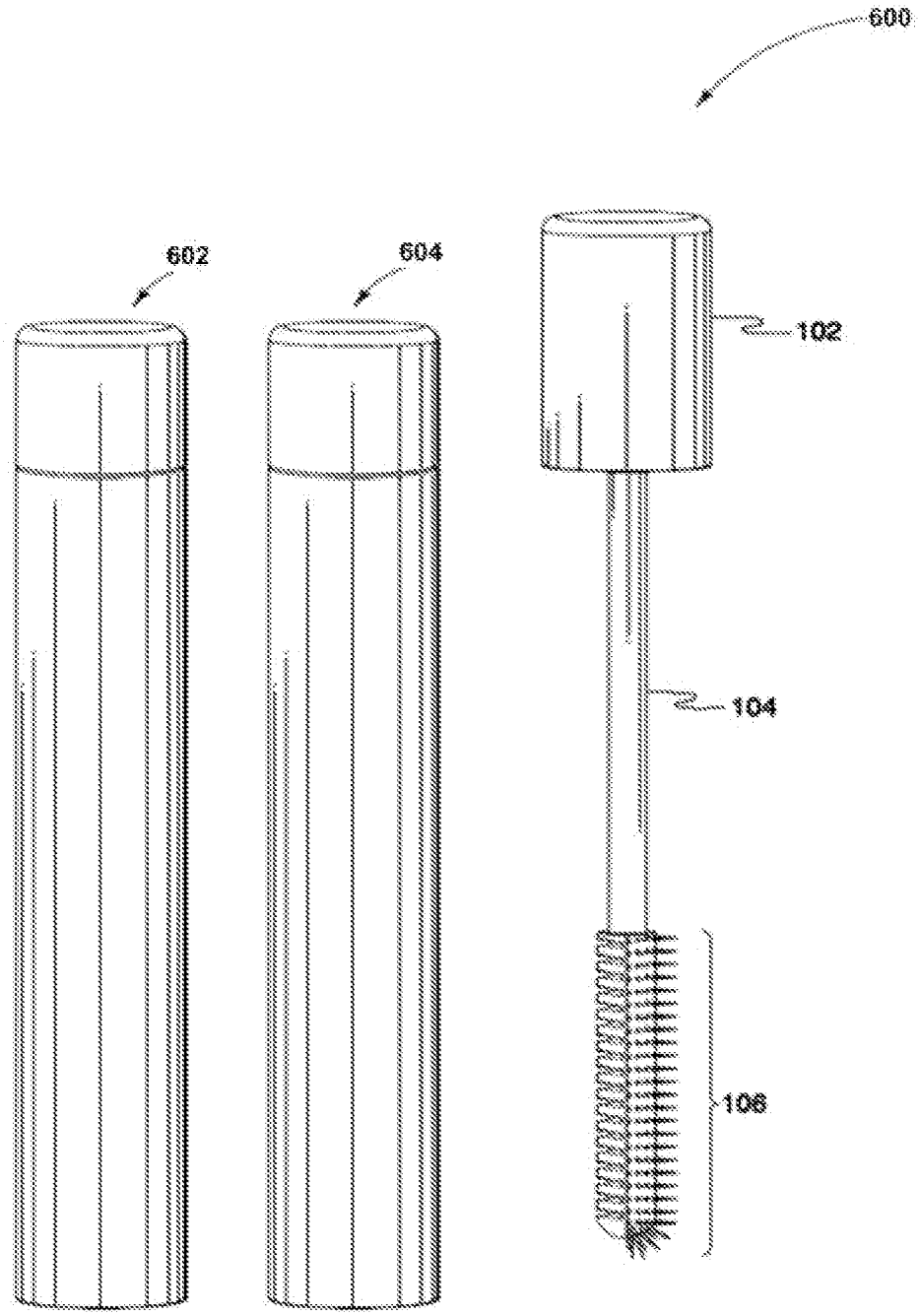
FIG. 6 illustrates a side view of an example applicator system.
Figure 7:
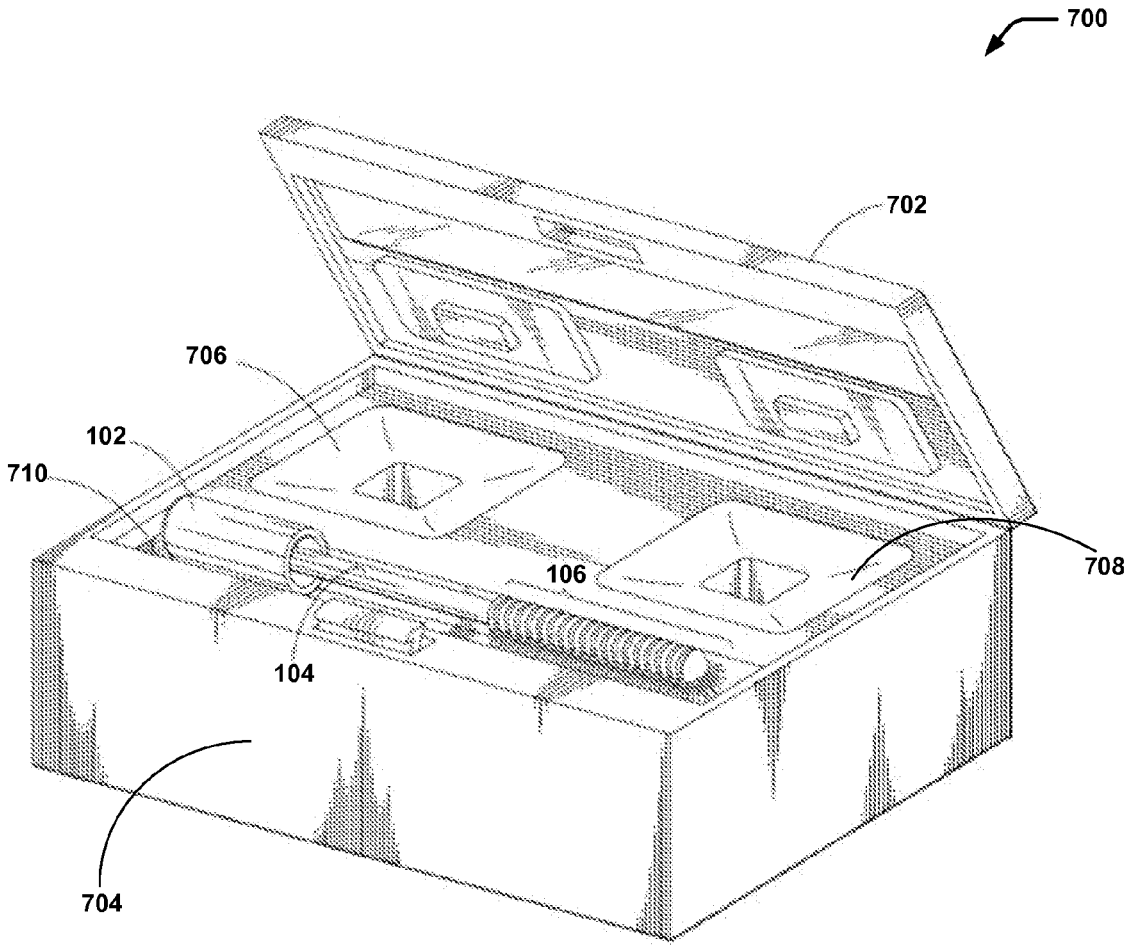
FIG. 7 illustrates a top perspective view of another example applicator system.

FIGS. 6 and 7 illustrate example applicator systems with the example implement of FIG. 1. These illustrative applicator systems may additionally or alternatively be used with implements having the plurality of teeth 404 or the plurality of clustered bristles, or other applicators. The illustrative implements may have features and may be made of materials similar to the components and to the features of the implement as discussed for FIGS. 1, 4, and 5. The following descriptions will focus on features and materials that are different for other embodiments of the applicator systems.

FIG. 6 illustrates a front view of an example applicator system 600. Shown also is a side view of the implement that includes the handle 102, the rod 104, and the applicator 106. The applicator system 600 includes two receptacles 602, 604 for receiving the implement and for storing the mascara and/or another product. In this example, the implement is reusable in both receptacles 602, 604. The user uses the implement to apply product from a first receptacle 602. Eventually, the user depletes the mascara from the first receptacle 602 and discards the first receptacle 602. The user then reuses the implement by inserting the implement into the second receptacle 604 that contains mascara and/or another product. In other embodiments, any number of receptacles or any types of products in the receptacles may be used with the implement.

FIG. 7 illustrates a top perspective view of another example applicator system 700. The illustrated configuration of the applicator system 700 is only one example arrangement. Many arrangements of the illustrated components, or other similar components, are possible. The example applicator system 700 has an automatic closure which includes a lid 702, a base 704 that includes one or more reservoirs 706, 708 for storing products and a well 710 for storing the implement.

The lid 702 and the base 704 may be constructed of materials including, but not limited to, glass, metal, wood, plastics, polymers, composites thereof, or the like. In some implementations, the lid 702 and/or the base 704 may be made at least partially of a resin such as, for example, acrylonitrile butadiene styrene (ABS), styrene acrylonitrile (SAN), pentachlorothioanisole (PCTA), polypropylene (PP), polyethylene (PE), polyurethane, combinations thereof, or the like. Moreover, the interior and/or exterior may be made of any combination of substantially clear, substantially opaque, and/or translucent materials. In one implementation, the exterior portions of the lid 702 and the base 704 are made of opaque ABS/SAN composite while the interior portions are made primarily of substantially clear or translucent a thermoplastic polymer, such as polypropylene.

The interior portion of the base 704 includes molded reservoirs 706, 708 and the well 710. The number and shape of the reservoirs 706, 708 and the well 710 may vary between embodiments. The reservoirs 706, 708 store products to be applied using the implement. The reservoirs may be formed in various shapes, such as rectangular, oval, and the like. In one embodiment, the well 710 may be heated or cooled to impart a thermal charge to the applicator 106 prior to or during use. The well 710 may be heated by a heating or cooling element disposed in the lid 702 and/or base 704 of the applicator system proximate to the well 710. The heating or cooling element may comprise, for example, a resistive or inductive heater powered by a battery or other power source, a reservoir of hot or cold liquid surrounding all or part of the well 710, or other suitable heating or cooling means.

In an embodiment, the applicator system 700 includes a mirror (not shown) in an interior of the lid 702. The mirror may cover the entire interior of the lid 702, one half area, or one third area of the lid 702. In another embodiment, the mirror may be located on an exterior of the applicator system 700 or an exterior of the base 704. In another embodiment, the applicator system 700 may omit the mirror.

Example Mechanisms of Coupling Applicator

Figure 8:
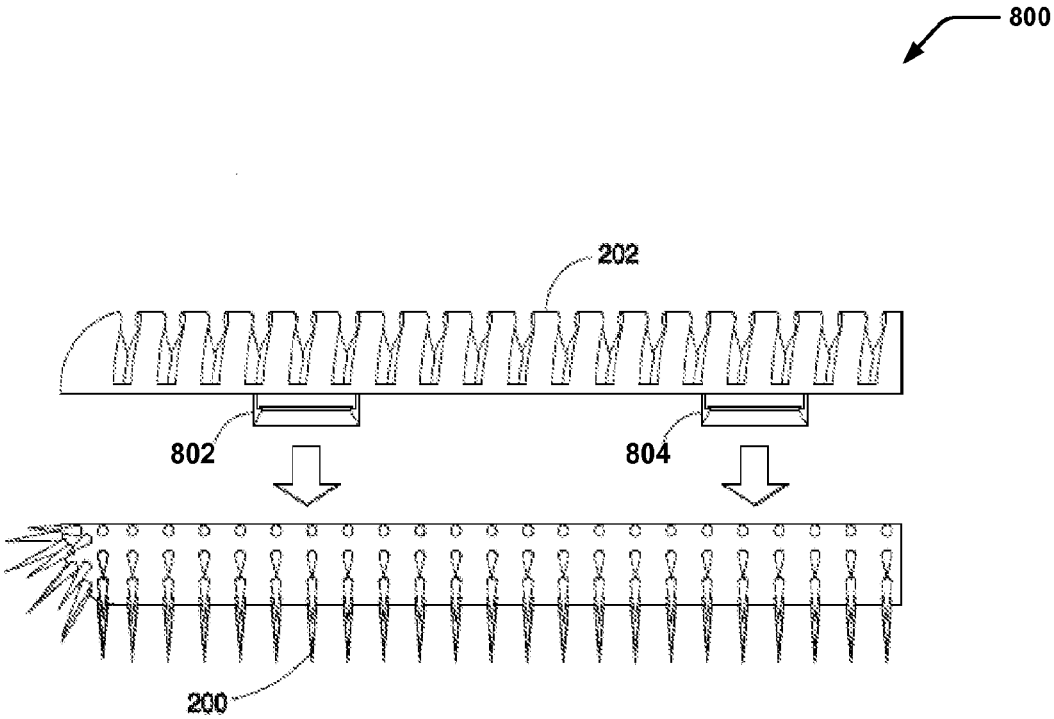
FIG. 8 illustrates a side view of an example mechanism for coupling first and second portions of an applicator.
Figure 9A:
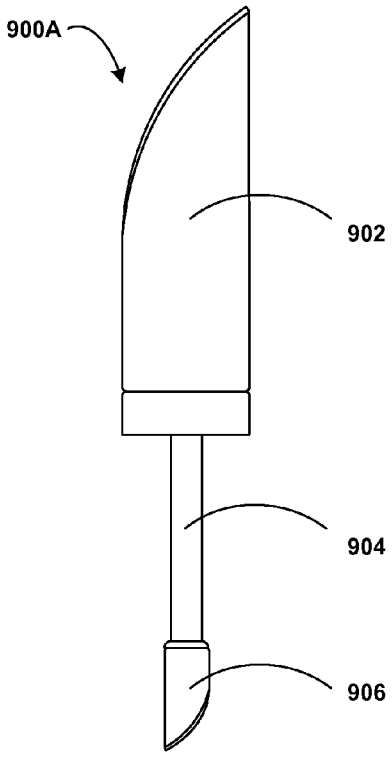
FIGS. 9A, 9B, 9C, and 9D illustrate additional examples of cosmetic implements with thermal storage applicators.
Figure 9B:
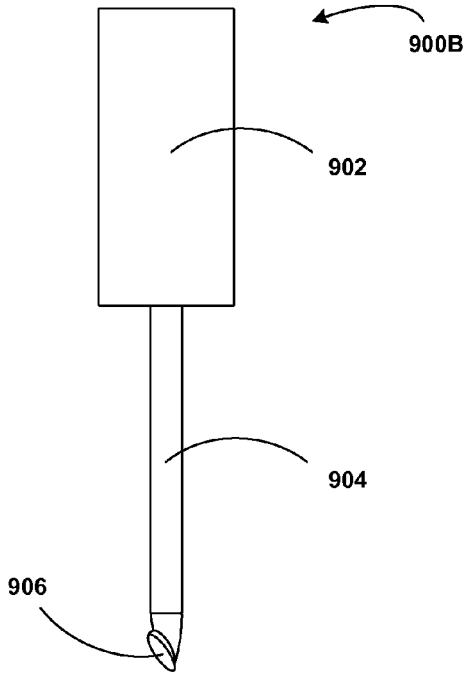
Figure 9C:
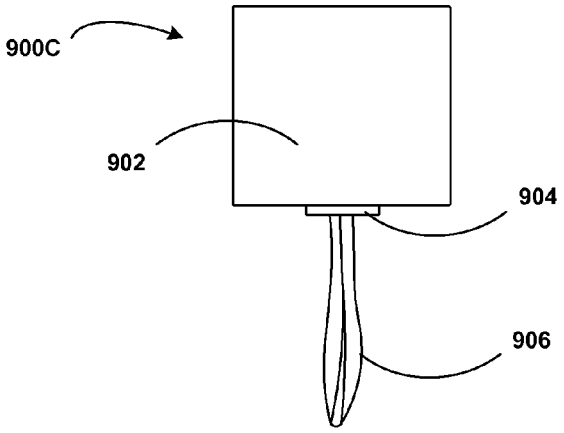
Figure 9D:
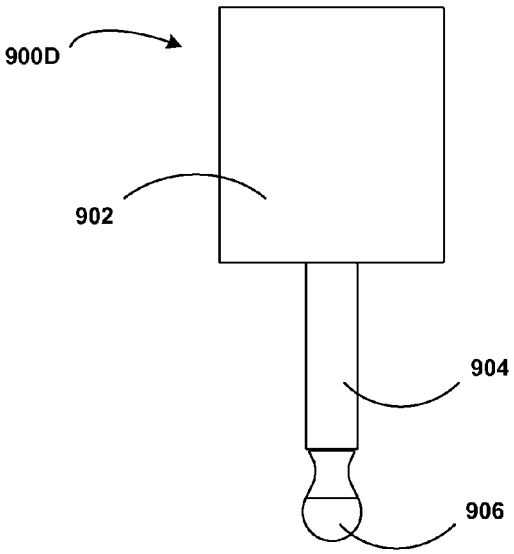

FIG. 8 illustrates a side view of an example mechanism 800 for coupling the plurality of channels 202 to the plurality of bristles 200. However, the coupling mechanism may also apply to the plurality of teeth 404 or the plurality of clustered bristles. The first portion that includes the plurality of channels 202 may be coupled to second portion that includes the plurality of bristles 200 by an attachment means of snap fit, using two mechanical components 802, 804. In embodiments, other mechanisms of coupling the first portion that includes the plurality of channels 202 to the second portion that includes the plurality of bristles 200, the plurality of teeth 404, or the plurality of clustered bristles, may include, but are not limited to, press fit, screw threads, pins with adhesive, fasteners, magnetic forces, slide lock, combinations of any of the foregoing, and the like.

In another embodiment, the first portion of the plurality of channels 202 may be coupled to the second portion of the plurality of bristles 200, the plurality of teeth 404, or the plurality of clustered bristles by over-molding or co-molding. The plurality of bristles 200, the plurality of teeth 404, or the plurality of clustered bristles may be over-molded over or co-molded with the plurality of channels 200 as a single unit.

In another embodiment, the first portion of the plurality of channels 202 may be coupled to the second portion of the plurality of bristles 200, the plurality of teeth 404, or the plurality of clustered bristles by casting. Casting is a manufacturing process by which a liquid material is poured into a mold, which contains a hollow cavity of a desired shape, and then allowed to solidify. The solidified part known as casting, is ejected or broken out of the mold to complete the process. Casting materials are usually metals so this process is applicable when the plurality of channels 202 are constructed of metal and the plurality of bristles 200, the plurality of teeth 404, or the plurality of clustered bristles are also constructed of similar type of material.

Additional Examples

FIGS. 9A-9D illustrate four additional examples of implements 900A, 900B, 900C, and 900D (collectively referred to as "implements 900") including a handle 902, a stem or wand 904, and a thermal storage applicator 906. The size, shape, and proportion of the handle, wand 904, and applicator 906 vary among the implements 900. By way of example and not limitation, the implements 900 in these examples may be used to apply a product, such as a lip gloss, lipstick, eyelid or under eye cream, or the like, to a user's lips or skin. Being made at least in part of a thermal storage material, the applicators 106 may be used to impart a thermal charge to the surface to which the product is applied.

Example Materials and Dimensions

While the foregoing embodiments describe that certain components are or may be made of certain materials, the specific materials listed for each component are merely illustrative examples. Any of the embodiments described herein may be made of any combination of materials described in this application. Similarly, mass, volume, surface area, and surface finish ranges given for specific embodiments are merely illustrative examples and other embodiments may have mass, volume, surface area, and/or surface finish outside the example ranges listed.

Example Uses and Benefits of Applicator

The user inserts the implement with the applicator 106, 402 into a receptacle 108 to retrieve product. The applicator 106, 402 is intended to apply the product to a surface, such as the eyelashes, eye brows, eyelid, under eye, lip, face, hair, nail, or skin of a user. In an example, the applicator 106, 402 includes a plurality of channels 202 constructed from metal, ceramic, or glass that can be heated or cooled and are able to retain the heated or cooled condition for a period of time. The applicator 106, 402 also includes the plurality of bristles 200 or the plurality of teeth 404 to retrieve and to apply the product. By virtue of the thermal retention of the plurality of channels 202, thermal energy may be applied to the product so that it may be heated or cooled during application. As the plurality of channels 202 transfers heat to or from the user's face, head, or body, the user to feels a thermal sensation (e.g., warm or cool depending on the thermal energy in the plurality of channels 202) when applying the product.

Furthermore, the thermal energy from the plurality of channels 202 may transfer to provide thermal energy to the product for easier flow upon application to avoid clumping of the product. For example, the user may apply product to eyelashes as the plurality of channels 202 provide thermal energy to the product via the plurality of bristles 200 or the plurality of teeth 404. Thus, the user avoids clumping of mascara on their eyelashes. For example, the thermal energy warms the product in the receptacle 108 for ease of application and avoids forming clumping of the eyelashes.

In addition, the user may use the applicator 106 as one technique to curl their eyelashes. For instance, the plurality of channels 202 may transfer heat to the user's eyelashes when being rolled up on upper eyelashes and down on lower eyelashes, thereby causing the eyelashes to curl.

In another embodiment, the heat transfer from the plurality of channels 202 may also minimize or alleviate pain or discomfort caused by damage to the face, the head, or the body. In particular, the user may guide the plurality of channels 202 through the lashes, against the face, through the hair, and/or against portions of the body.

In yet another embodiment, the user may apply product on the applicator 106 at ambient temperature. At ambient temperature, the applicator 106 may still cause a cooling sensation to the face, the head, or the body of the user due to the material of the channels to quickly dissipate body heat.

In yet another embodiment, the plurality of channels 202 or the fins may provide a large surface area that allows high rates of heat transfer to and from the face, head, or body and the surrounding air. Thus, the plurality of channels 202 or the fins may serve as a heat sink to quickly transfer heat from the face, head, or body to the applicator 106.

CONCLUSION

Although the invention has been described in language specific to structural features and/or methodological acts, it is to be understood that the claims are not necessarily limited to the specific features or acts described. Rather, the specific features and acts are disclosed as illustrative forms of implementing example embodiments.

What is claimed is:

1. An implement for applying a product to a surface, the implement comprising:

a handle;

a rod having a top end and a bottom end, the top end of the rod being coupled to the handle;

an applicator having a proximal end attached to the bottom end of the rod, the applicator comprising (i) a first portion comprising a metal, ceramic, or glass capable of imparting a thermal sensation to the surface and (ii) a second portion opposite the first portion, the second portion comprising a metal and having a plurality of teeth in a comb configuration for applying the product to the surface, wherein the first portion and the second portion are removably coupled to one another via at least one of a snap fit mechanism, a press fit, screw threads, pins with adhesive, over-molding, or casting, wherein the rod and at least the first portion of the applicator are each made of different materials; and the first portion coupled to the second portion.

2. The implement of claim 1, wherein the first portion comprises a plurality of channels configured to transfer heat or cold during application of the product to the surface.

3. The implement of claim 1, wherein the first portion comprises a plurality of channels, each channel being spaced about 0.8 millimeters apart from each other.

4. The implement of claim 1, wherein the second portion and the plurality of teeth comprises at least one of carbon steel, stainless steel, aluminum, brass, chrome, copper, gold, nickel, silver, titanium, and/or Zamac.

5. The implement of claim 1, wherein:

the second portion comprises at least one of carbon steel, stainless steel, aluminum, chrome, copper, nickel, or titanium; and the plurality of teeth comprises at least one of low density polyethylene (LDPE), thermoplastic elastomer (TPE), polypropylene (PP), or silicone.

* * * * *